US010113744B2

(12) United States Patent
Takatsu

(10) Patent No.: US 10,113,744 B2
(45) Date of Patent: Oct. 30, 2018

(54) CERAMIC HEATER-TYPE GLOW PLUG

(71) Applicant: Bosch Corporation, Tokyo (JP)

(72) Inventor: Katsumi Takatsu, Saitama (JP)

(73) Assignee: Bosch Corporation, Tokyo (JP)

( * ) Notice: Subject to any disclaimer, the term of this patent is extended or adjusted under 35 U.S.C. 154(b) by 275 days.

(21) Appl. No.: 15/129,051

(22) PCT Filed: Mar. 9, 2015

(86) PCT No.: PCT/JP2015/056769
§ 371 (c)(1),
(2) Date: Sep. 26, 2016

(87) PCT Pub. No.: WO2015/146555
PCT Pub. Date: Oct. 1, 2015

(65) Prior Publication Data

US 2017/0108218 A1 Apr. 20, 2017

(30) Foreign Application Priority Data

Mar. 27, 2014 (JP) ..... 2014-065913

(51) Int. Cl.

| | |
|---|---|
| ***F23Q 7/00*** | (2006.01) |
| ***H05B 3/48*** | (2006.01) |
| ***F02P 19/02*** | (2006.01) |
| *H05B 3/03* | (2006.01) |

(52) U.S. Cl.
CPC ..... *F23Q 7/001* (2013.01); *F02P 19/026* (2013.01); *H05B 3/48* (2013.01); *F23Q 2007/004* (2013.01); *H05B 3/03* (2013.01); *H05B 2203/016* (2013.01); *H05B 2203/027* (2013.01)

(58) Field of Classification Search
None
See application file for complete search history.

(56) References Cited

U.S. PATENT DOCUMENTS 4,661,686 A * 4/1987 Yokoi ..... F23Q 7/001 123/145 A
5,059,768 A * 10/1991 Hatanaka ..... F23Q 7/001 123/145 A
5,998,765 A * 12/1999 Mizuno ..... F23Q 7/001 123/145 A
6,013,898 A * 1/2000 Mizuno ..... F23Q 7/001 123/145 A (Continued)

FOREIGN PATENT DOCUMENTS

JP 59170620 9/1984
JP 4172486 10/2008

(Continued)

OTHER PUBLICATIONS

JP5324905, issued version of JP2010-139152A, Jun. 2010, Ito, partial translation.*

(Continued)

*Primary Examiner* — Joseph M Pelham
(74) *Attorney, Agent, or Firm* — Michael Best & Friedrich LLP

(57) ABSTRACT

A ceramic heater-type glow plug that includes a ceramic heater, and a metallic outer cylinder, one end side of which holds the ceramic heater and the other end side of which is inserted in and fixed to an inner hole of a housing.

18 Claims, 3 Drawing Sheets

(56) References Cited

U.S. PATENT DOCUMENTS

| | | | | |
|---|---|---|---|---|
| 6,204,481 | B1 * | 3/2001 | Ito | H05B 3/141 123/145 A |
| 6,689,990 | B2 * | 2/2004 | Taniguchi | F23Q 7/001 123/145 A |
| 6,737,612 | B2 * | 5/2004 | Taniguchi | F23Q 7/001 123/145 A |
| 2003/0029856 | A1 * | 2/2003 | Tatematsu | F23Q 7/001 219/270 |
| 2007/0289960 | A1 | 12/2007 | Tanaka et al. | |
| 2014/0352640 | A1 * | 12/2014 | Okinaka | F02P 19/028 123/145 A |
| 2015/0048077 | A1 * | 2/2015 | Kobayashi | H05B 3/12 219/541 |
| 2017/0038069 | A1 * | 2/2017 | Takatsu | F23Q 7/00 |

FOREIGN PATENT DOCUMENTS

| | | | |
|---|---|---|---|
| JP | 2010139152 | A * | 6/2010 |
| JP | 2013228123 | | 11/2013 |

OTHER PUBLICATIONS

International Search Report for Application No. PCT/JP2015/056769 dated Jun. 2, 2015 (English Translation, 2 pages).

* cited by examiner

CERAMIC HEATER-TYPE GLOW PLUG

BACKGROUND OF THE INVENTION

The invention relates to a ceramic heater-type glow plug that is used to assist in starting of a diesel engine.

A ceramic heater-type glow plug that is used to assist in starting of a diesel engine typically has a structure of holding a rear end side of a ceramic heater in a metallic outer cylinder in a state where a heat generating section on a tip side of the ceramic heater is projected to the outside. In such a ceramic heater-type glow plug, a rear end side of the outer cylinder is inserted in and fixed to a tip of a cylindrical housing that is a mounting fixture to a cylinder head of the engine.

In general, manufacturing cost of the ceramic heater-type glow plug heavily depends on length of a ceramic portion. Thus, for a purpose of cutting the manufacturing cost by reducing the length of the ceramic portion, as depicted in FIG. 3, a ceramic heater-type glow plug 300 has practically been used, the ceramic heater-type glow plug 300 having such a structure that one electrode (a negative electrode) 312 of a ceramic heater 310 is exposed on an outer surface of a ceramic insulating substrate 311 and is electrically connected to an inner surface of an outer cylinder 320 and that the other electrode (a positive electrode) 313 is exposed to the outside of the outer cylinder 320 from a rear end thereof via an electrode exposing tool 330 and an electrode exposing rod 340. More specifically, the electrode that has been exposed to the outside of the outer cylinder 320 by the electrode exposing tool 330 and the electrode exposing rod 340 is electrically connected to an external connection terminal 360 that is fixed on a rear end side of a housing 350 via an insulator 370 (for example, see Japanese Patent No. 4,172,486).

Here, the electrode exposing tool 330 that includes a relatively thin lead wire is used in the ceramic heater-type glow plug 300 as disclosed in Japanese Patent No. 4,172,486. Thus, a temperature of the electrode exposing tool 330 may substantially exceed an upper temperature limit thereof. For this reason, the outer cylinder 320 is filled with insulating ceramic power 380, heat of the electrode exposing tool 330 is dissipated via the ceramic power 380, and a temperature increase of the electrode exposing tool 330 is thereby suppressed.

SUMMARY OF THE INVENTION

However, in a manufacturing process of such a glow plug 300, it is required to fill the outer cylinder 320 with the ceramic power 380 and to perform swaging (diameter shrinkage processing) on the outer cylinder 320. Accordingly, not only the structure itself is complicated, but also the manufacturing steps are complicated. Thus, an effect of cutting the manufacturing cost is possibly reduced. In addition, components such as the ceramic heater 310, the electrode exposing tool 330, and the electrode exposing rod 340 are possibly manufactured in such a manner that tolerance of concentricity of each of these exceeds an allowable limit. In the case where the glow plug 300 is manufactured in such a manner that the tolerance of the concentricity thereof exceeds the allowable limit, such a problem arises that a joined section of each of the components is fractured due to bending stress that is generated in conjunction with use of the glow plug 300.

The invention has been made in view of the above problem and therefore has a purpose of providing a ceramic heater-type glow plug, a structure and manufacturing steps of which are simplified when compared to the related art, and a fracture in which can be prevented.

In order to solve the above problem, the invention is a ceramic heater-type glow plug that includes: a ceramic heater; and a metallic outer cylinder, one end side of which holds the ceramic heater and the other end side of which is inserted in and fixed to an inner hole of a housing and is characterized by having: one electrode of the ceramic heater on an outer circumferential surface of the ceramic heater and the other electrode at a rear end of the ceramic heater; a first large-diameter lead section that is connected to the other electrode and has electrical conductivity; a second large-diameter lead section that is connected to a rear end of the first large-diameter lead section and is made of a different electrical conductive material from the first large-diameter lead section; an elastic member with electrical conductivity that is connected to a rear end of the second large-diameter lead section by welding; and an external connection terminal that is connected to a rear end of the elastic member.

As one aspect of the invention, the second large-diameter lead section is preferably made of iron, an iron alloy, nickel, or a nickel alloy.

As one aspect of the invention, the elastic member is preferably made of iron, the iron alloy, nickel, or the nickel alloy.

As one aspect of the invention, each of the ceramic heater and the outer cylinder, the ceramic heater and the first large-diameter lead section, and the first large-diameter lead section and the second large-diameter lead section is preferably brazed.

As one aspect of the invention, the elastic member is preferably a compression coil spring, and the elastic member is preferably connected to the second large-diameter lead section and the external connection terminal in a state where a strand of the compression coil spring is in close contact therewith.

As one aspect of the invention, rigidity of the first large-diameter lead section is preferably set to be lower than that of the external connection terminal.

As one aspect of the invention, the first large-diameter lead section is preferably made of copper, a copper alloy, aluminum, an aluminum alloy, or cast iron.

As one aspect of the invention, in the case where a diameter of the first large-diameter lead section is set as 1.0, axial length of the first large-diameter lead section is preferably set to have a value of 2.0 or higher.

As one aspect of the invention, in the case where a lateral cross-sectional area of the ceramic heater is set as 1.0, a lateral cross-sectional area of the first large-diameter lead section is preferably set to have a value within a range from 0.2 to 0.4.

As one aspect of the invention, a lateral cross-sectional area of the second large-diameter lead section is preferably the same as the lateral cross-sectional area of the first large-diameter lead section.

According to the invention, a structure and manufacturing steps of the ceramic heater-type glow plug can be simplified when compared to the related art, and a fracture in the glow plug can be prevented.

DETAILED DESCRIPTION

A description will be made on a preferred embodiment of the invention with reference to the drawings. Note that the embodiment, which will be described below, is merely one example and various embodiments can be adopted within the scope of the invention.

Figure 1:
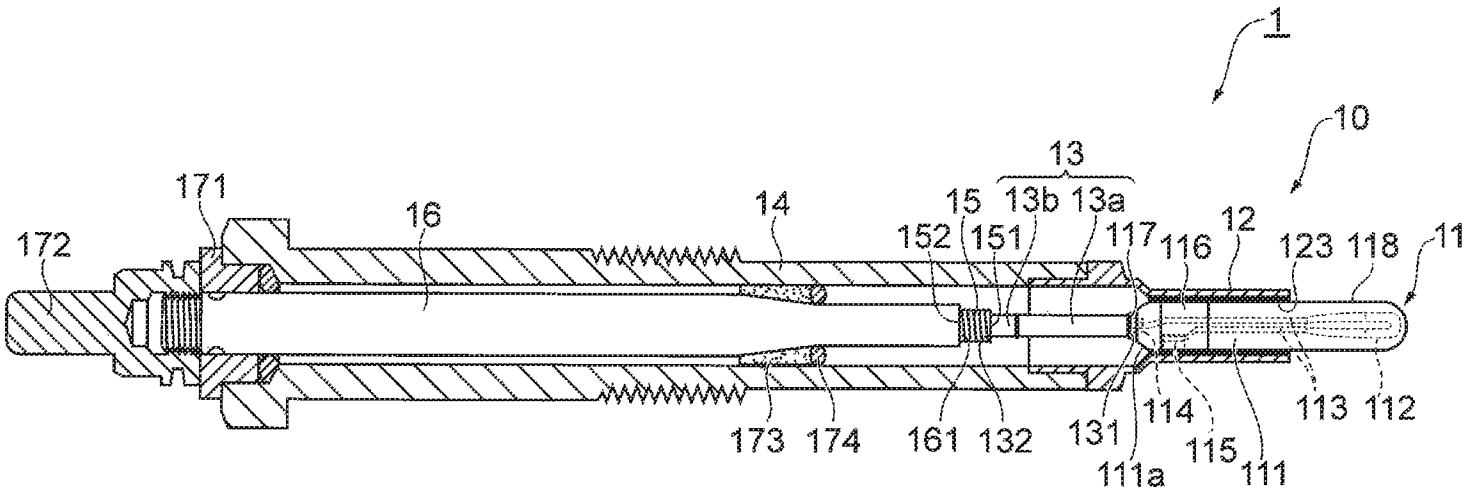
FIG. 1 is a vertical cross-sectional view of a ceramic heater-type glow plug according to an embodiment of the invention.

FIG. 1 is a vertical cross-sectional view of a ceramic heater-type glow plug 1 for a diesel engine according to the embodiment of the invention. The glow plug 1 depicted in FIG. 1 includes a ceramic heater assembly 10, a housing 14, a coil spring 15, a lead rod 16, and the like. Note that a lateral cross-sectional view used in the specification and the claims means a cross-sectional view that is perpendicular to a longitudinal axis of the ceramic heater-type glow plug 1. In addition, a vertical cross-sectional view used in the specification means a cross-sectional view that includes the longitudinal axis of the ceramic heater-type glow plug 1.

The ceramic heater assembly 10 includes a ceramic heater 11, a metallic outer cylinder (sheath) 12, a large-diameter lead section 13, and the like. The large-diameter lead section 13 includes a first large-diameter lead section 13*a* and a second large-diameter lead section 13*b*.

The ceramic heater 11 is a portion that is heated by energization, and a ceramic heat generating body 112 that is formed in a U shape is embedded in a ceramic insulating substrate 111 that configures a body section of the ceramic heater 11. A positive electrode 114 and a negative electrode 115 are provided on both end sides of this ceramic heat generating body 112 via metal leads 113. The negative electrode 115 is exposed on an outer circumferential surface of the ceramic insulating substrate 111, and a negative electrode side metalized section 116 is formed in the outer circumferential surface of the ceramic insulating substrate 111 that includes the negative electrode 115. This negative electrode side metalized section 116 is joined to an inner surface of the outer cylinder 12 by brazing or the like, and the negative electrode 115 is electrically connected to the outer cylinder 12. That is, the outer cylinder 12 is formed of a metal material with electrical conductivity.

Note that dimensions of the ceramic heater 11 and the outer cylinder 12 are determined such that a gap between an inner circumferential surface 123 of the outer cylinder 12 and an outer circumferential surface 118 of the ceramic heater 11 becomes approximately 20 to 30 μm at a time when the ceramic heater 11 is inserted in the outer cylinder 12.

On a rear end side that is opposite from a tip side on which the ceramic heat generating body 112 is embedded, the positive electrode 114 is exposed on an outer surface of the ceramic insulating substrate 111. A positive electrode side metalized section 117 is formed in a rear end surface of the ceramic insulating substrate 111 that includes the positive electrode 114. This positive electrode side metalized section 117 is joined to a tip surface 131 of the first large-diameter lead section 13*a* by brazing or the like, and the positive electrode 114 and the first large-diameter lead section 13*a* are electrically connected.

Here, a chamfered section 111*a* is formed in the rear end surface of the ceramic insulating substrate 111. In this way, a distance between the ceramic insulating substrate 111 and the outer cylinder 12 can be increased around a joined section between the ceramic insulating substrate 111 and the first large-diameter lead section 13*a*. Accordingly, in a case of brazing, an insulating property between a brazing material and the outer cylinder 12 can be increased. Thus, a chance of insulation breakdown can be reduced.

During an actuation of the glow plug 1, a large current (for example, 4 to 30 amperes) that causes generation of a high temperature flows through the large-diameter lead section 13 (the first large-diameter lead section 13*a* and the second large-diameter lead section 13*b*). Accordingly, in the case where a diameter of the large-diameter lead section 13 is excessively small, such as being less than 1 mm, with self-generating heat, the large-diameter lead section 13 is possibly oxidized in a short time period. Thus, the large-diameter lead section 13 is formed as a lead rod with a relatively large diameter and, for example, has a lateral cross-sectional area that is 20% or higher of a lateral cross-sectional area of the ceramic insulating substrate 111.

On the contrary, in the case where the diameter of the large-diameter lead section 13 is excessively large, a sufficient distance cannot be secured between the large-diameter lead section 13 and the outer cylinder 12, which possibly leads to the insulation breakdown. Thus, the lateral cross-sectional area of the large-diameter lead section 13 is preferably 40% or smaller of the lateral cross-sectional area of the ceramic insulating substrate 111, for example. In addition, the first large-diameter lead section 13*a* and the second large-diameter lead section 13*b* have substantially the same diameter. Note that the first large-diameter lead section 13*a* is preferably at least twice as long as the diameter of the first large-diameter lead section 13*a*.

The first large-diameter lead section 13*a* is formed of a material that has lower rigidity and higher electrical conductivity than the lead rod 16 as an external connection terminal. As such a material, copper (Cu), aluminum (Al), or alloys of those can be raised, for example. Alternatively, an iron alloy or cast iron with low rigidity and high electrical conductivity can be used.

In addition, the second large-diameter lead section 13*b* is formed of iron (Fe), the iron alloy, nickel (Ni), or a nickel alloy.

Furthermore, the first large-diameter lead section 13*a* and the second large-diameter lead section 13*b* are joined by brazing or the like. Note that the large-diameter lead section 13 may be nickel (Ni) plated for a purpose of improving thermal resistance or may be coated with silver (Ag) for a purpose of improving an oxidation resistance property.

The housing 14 is a mounting fixture to a cylinder head of an engine, which is not depicted, and houses the outer cylinder 12 and the large-diameter lead section 13. The housing 14 is formed in a cylindrical shape, for example, and the ceramic heater assembly 10 that is configured as described above is fixed thereto by brazing or the like. In an example of FIG. 1, the outer cylinder 12 is fixed to the inside of the housing 14 by brazing or the like. However, as another mode, the outer cylinder 12 is fixed to the inside of a metal pipe or the like (not depicted) by brazing or the like, the metal pipe and a member that configures a housing body is welded, and the integrated housing 14 can thereby be formed.

The coil spring 15 functions to absorb bending stress by deformation thereof so as to maintain concentricity when the bending stress is applied from the ceramic heater assembly 10 to the lead rod 16.

The coil spring 15 is formed of a compression coil spring as an elastic member. The coil spring 15 is made of iron (Fe), the iron alloy, nickel (Ni), the nickel alloy, or those that are obtained by plating them with nickel. Here, the coil spring 15 is preferably formed of the same material as the second large-diameter lead section 13*b* from a point of facilitation of welding.

The coil spring 15 is housed in the housing 14, and a tip 151 thereof is joined to a rear end surface 132 of the second large-diameter lead section 13*b* by resistance welding or the like (for example, spot welding). A rear end 152 of the coil spring 15 is joined to a tip surface 161 of the lead rod 16 by resistance welding or the like. Note that the coil spring 15 is provided between the second large-diameter lead section 13*b* and the lead rod 16 in a state where a strand thereof is in close contact therewith, and, as a result, the second large-diameter lead section 13*b*, the coil spring 15, and the lead rod 16 are electrically connected.

The lead rod 16 is housed in the housing 14 and is fixed by a filler 173 that is made of a resin, a low melting point glass, or the like and that is filled between the lead rod 16 and the housing 14 and by a sealing 174.

The lead rod 16 is formed of an iron-based material such as S25C and is formed of a material that can easily be welded to the coil spring 15 by resistance welding.

The lead rod 16 is held by an insulator 171 on a rear end side of the housing 14, and a rear end thereof is exposed to the outside of the housing 14 and is connected to a round pin 172.

Based on FIG. 2, a manufacturing method of the glow plug 1 for the diesel engine will be described.

Figures 2A, 2B, 2C, 2D, 2E:
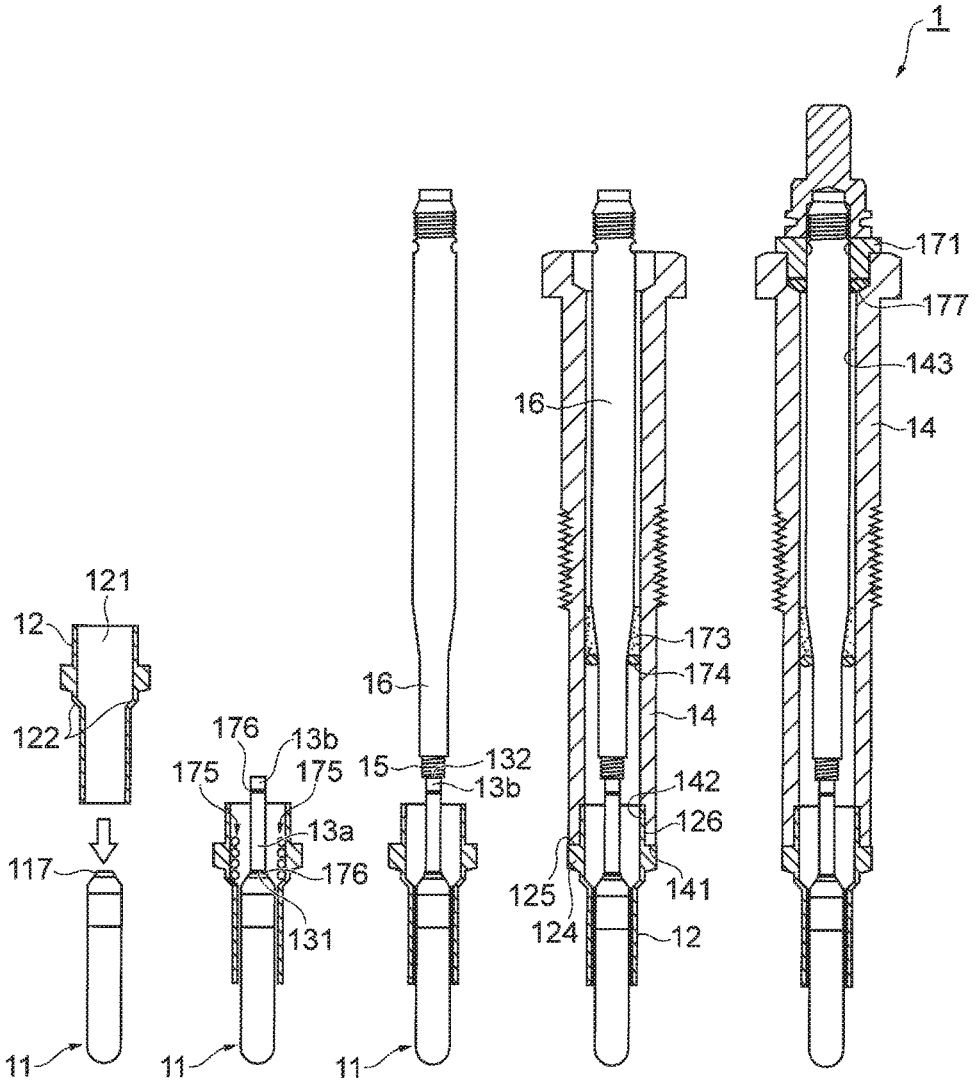
FIGS. 2(*a*), 2(*b*), 2(*c*), 2(*d*) and 2(*e*) are views that depict a manufacturing method of a ceramic heater assembly for the ceramic heater-type glow plug according to the embodiment of the invention.
Figure 3:
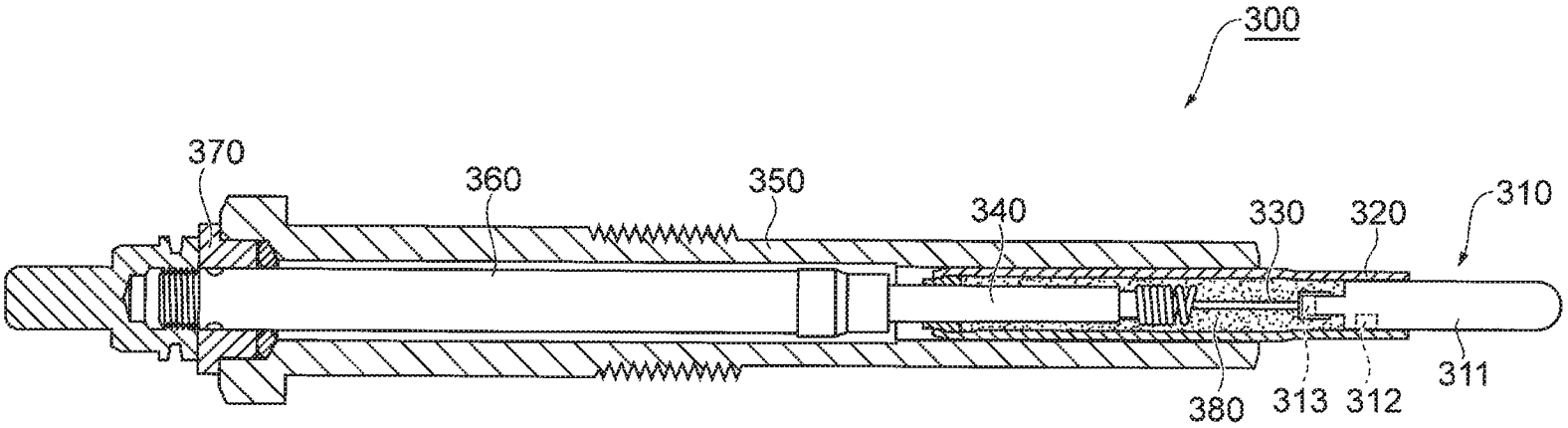
Fig. 3 PRIOR ART
FIG. 3 is a vertical cross-sectional view of a conventional ceramic heater-type glow plug.

As depicted in FIG. 2(*a*), the ceramic heater 11 is inserted in an inner hole 121 of the outer cylinder 12. The ceramic heater 11 is inserted in the outer cylinder 12 up to a position where a shoulder section 122 of the outer cylinder 12 and the positive electrode side metalized section 117 of the ceramic heater 11 establish a specified positional relationship (for example, see FIG. 2(*b*)).

Next, as depicted in FIG. 2(*b*), a brazing material 175 is placed on the shoulder section 122 of the outer cylinder 12. In addition, the tip surface 131 of the first large-diameter lead section 13*a* is placed on the positive electrode side metalized section 117 of the ceramic heater 11. Furthermore, the second large-diameter lead section 13*b* is placed on the first large-diameter lead section 13*a*. At this time, a brazing material 176 that differs from the brazing material 175 placed on the shoulder section 122 is placed between the positive electrode side metalized section 117 and the first large-diameter lead section 13*a* and between the first large-diameter lead section 13*a* and the second large-diameter lead section 13*b*.

Next, in a state where the outer cylinder 12, the ceramic heater 11, the large-diameter lead section 13 (the first large-diameter lead section 13*a* and the second large-diameter lead section 13*b*), and the coil spring 15 are temporarily assembled, this assembly is heated to 800 to 900° C. In this way, the ceramic heater 11 and the outer cylinder 12, the ceramic heater 11 and the first large-diameter lead section 13*a*, and the first large-diameter lead section 13*a* and the second large-diameter lead section 13*b* are simultaneously brazed.

Next, as depicted in FIG. 2(*c*), the rear end surface 132 of the second large-diameter lead section 13*b* and the coil spring 15 as well as the coil spring 15 and the lead rod 16 are joined by welding (for example, spot welding) and are fixed.

Next, as depicted in FIG. 2(*d*), the housing 14 is lowered until a tip surface 141 of the housing 14 abuts against a rear end surface 125 of a projected section 124 of the outer cylinder 12. In such an abutment state, the tip surface 141 of the housing 14 and the rear end surface 125 of the projected section 124 of the outer cylinder 12 are welded. Note that the housing 14 and the outer cylinder 12 may be fixed by brazing an inner circumferential surface 142 of the housing 14 and an outer circumferential surface 126 of the outer cylinder 12.

In addition, as depicted in FIG. 2(*d*), the sealing 174 is inserted between the housing 14 and the lead rod 16. Then, the filler 173 that is made of the resin, the low melting point glass, or the like is filled between the lead rod 16 and the housing 14.

Finally, as depicted in FIG. 2(*e*), a rear end of an inner hole 143 of the housing 14 is sealed by the insulator 171. At this time, an O-ring 177 is provided between the insulator 171 and the housing 14.

According to the above-described configuration, the large-diameter lead section 13 and the lead rod 16 are connected via the coil spring 15. Thus, even in the case where the glow plug 1 is manufactured in such a manner that tolerance of concentricity thereof exceeds an allowable limit, the coil spring 15 can release the bending stress that is generated during use and during assembly of the glow plug 1. In this way, it is possible to avoid a fracture in each of a connected section between the lead rod 16 and the coil spring 15, a connected section between the coil spring 15 and the second large-diameter lead section 13*b*, a connected section between the second large-diameter lead section 13*b* and the first large-diameter lead section 13*a*, and a connected section between the first large-diameter lead section 13*a* and the ceramic heater 11.

In addition, because the second large-diameter lead section 13*b* is made of Fe, the Fe alloy, Ni, or the Ni alloy, the second large-diameter lead section 13*b* and the coil spring 15 can be joined by spot welding. Thus, compared to a case of brazing, manufacturing time and manufacturing cost can substantially be reduced.

In addition, because the positive electrode side metalized section 117 of the ceramic heater 11 is connected to the lead rod 16 by using the large-diameter lead section 13 (the first large-diameter lead section 13*a* and the second large-diameter lead section 13*b*), resistance of the large-diameter lead section 13 can be reduced. Thus, the configuration can be simplified. Furthermore, even in the case where the large current that causes the generation of the high temperature flows, the self-generating heat can be suppressed, and thus the temperature of the large-diameter lead section 13 can be prevented from becoming an upper temperature limit thereof or higher. Therefore, it is possible to prevent degradation of the large-diameter lead section 13 due to oxidization for a long time period. Moreover, by using the large-diameter lead section 13, modes of the other components can also be simplified, and thus manufacturing steps can also be simplified.

In addition, the ceramic heater 11 and the metallic outer cylinder 12, the ceramic heater 11 and the first large-diameter lead section 13*a*, and the first large-diameter lead section 13*a* and the second large-diameter lead section 13*b* can simultaneously be brazed in one manufacturing step.

In addition, the coil spring 15 is the compression coil spring, and the coil spring 15 is connected to the second large-diameter lead section 13*b* and the lead rod 16 in a state where the strand thereof is in close contact therewith. Thus, resistance of the coil spring 15 itself can be reduced, and a temperature of the coil spring 15 can be prevented from becoming an upper temperature limit thereof or higher. Furthermore, because the coil spring 15 constantly presses the second large-diameter lead section 13*b* toward the ceramic heater 11, a preload can be applied to a joined section between the ceramic heater 11 and the first large-diameter lead section 13*a*. Accordingly, even in the case where a temperature cycle in which heating and cooling is repeated is applied to the first large-diameter lead section 13*a* during an operation of the glow plug 1, thermal stress that is generated in the first large-diameter lead section 13*a* is absorbed by the coil spring 15. Thus, a fracture in the joined section between the first large-diameter lead section 13*a* and the ceramic heater 11 can be prevented.

In addition, because of being made of iron, the iron alloy, nickel, or the nickel alloy, the coil spring 15 can be welded to the lead rod 16 by resistance welding, and thus the manufacturing step can be simplified.

Furthermore, by reducing the rigidity of the first large-diameter lead section 13*a* to be lower than that of the lead rod 16, the first large-diameter lead section 13*a* is likely to be deflected. Thus, stress concentration on a joined section between the first large-diameter lead section 13*a* and the positive electrode side metalized section 117 of the ceramic heater 11 or a joined section between the first large-diameter lead section 13*a* and the second large-diameter lead section 13*b* can be alleviated. More specifically, even in the case where the bending stress is generated in each of the joined sections due to vibrations during driving of the engine or due to the stress that is applied to the periphery of the joined section during the assembly of the glow plug 1, the first large-diameter lead section 13*a* is deflected, and thus concentration of the bending stress on the joined section can be avoided.

In addition, because the first large-diameter lead section 13*a* is made of copper, the copper alloy, aluminum, the aluminum alloy, or cast iron, the first large-diameter lead section 13*a* with the relatively low rigidity and the high electrical conductivity can be formed. By increasing the electrical conductivity, an effect of suppressing the self-generating heat, which is achieved by increasing a diameter of the lead wire, can further be increased.

Furthermore, in the case where the diameter of the first large-diameter lead section 13*a* is set as 1.0, an axial length of the first large-diameter lead section 13*a* is set to have a value of 2.0 or higher. In this way, the first large-diameter lead section 13*a* can sufficiently be deflected. Thus, even in the case where the bending stress is generated in each of the joined sections due to the vibrations during driving of the engine or due to the stress that is applied to the periphery of the joined section during the assembly of the glow plug 1, the first large-diameter lead section 13*a* is deflected, and thus the concentration of the bending stress on the joined section can be avoided.

In addition, in the case where a lateral cross-sectional area of the ceramic heater 11 is set as 1.0, a lateral cross-sectional area of the first large-diameter lead section 13*a* is set to have a value within a range from 0.2 to 0.4. Accordingly, joint strength of each of the joined section between the first large-diameter lead section 13*a* and the positive electrode side metalized section 117, the joined section between the first large-diameter lead section 13*a* and the second large-diameter lead section 13*b*, and the joined section between the second large-diameter lead section 13*b* and the coil spring 15 can be increased. Thus, it is possible to obtain the joint strength that can endure the vibrations that are generated in the case where the glow plug 1 is fixed to the engine of a vehicle or the like for use, the stress added to the glow plug 1 during manufacturing thereof, and the like. Furthermore, an electrical insulation property between the large-diameter lead section 13 and the outer cylinder 12 can be secured.

In addition, the thermal resistance of the large-diameter lead section 13 can further be increased by applying nickel (Ni) plating or the like to the large-diameter lead section 13. Furthermore, by further increasing thermal conductivity of the large-diameter lead section 13, the heat that is transmitted from the ceramic heater 11 can efficiently be transmitted to the lead rod 16, and thus the thermal resistance of the large-diameter lead section 13 can further be increased.

Furthermore, durability (particularly, the oxidation resistance property) of the large-diameter lead section 13 can be improved by coating the large-diameter lead section 13 with silver (Ag).

In addition, the lead rod 16 is fixed in the housing 14 by the filler 173 that is the resin or the like. Thus, when a connector, which is not depicted, is inserted in the round pin 172 or the round pin 172 is screwed, the stress that is added to the lead rod 16 is not applied to a joined section between the lead rod 16 and the coil spring 15, the joined section between the coil spring 15 and the second large-diameter lead section 13*b*, the joined section between the second large-diameter lead section 13*b* and the first large-diameter lead section 13*a*, and the joined section between the first large-diameter lead section 13*a* and the ceramic heater 11. Thus, the fracture in each of the joined sections can be prevented. Furthermore, there is a case where the stress is generated in each portion of the glow plug 1 due to the vibrations that are applied from the engine in a state where the glow plug 1 is mounted to the engine. However, because the lead rod 16 is fixed by the filler 173, the stress that is added to each of the joined section between the lead rod 16 and the coil spring 15, the joined section between the coil spring 15 and the second large-diameter lead section 13*b*, the joined section between the second large-diameter lead section 13*b* and the first large-diameter lead section 13*a*, and the joined section between the first large-diameter lead section 13*a* and the ceramic heater 11 can be reduced. Furthermore, the heat that is transmitted from the ceramic heater 11 via the large-diameter lead section 13 can be released to the housing 14 via the filler 173.

For the glow plug 1 with such a structure, the ceramic heater 11 can be shortened, and a step of filling the outer cylinder 12 with the powder and a step of reducing the diameter of the outer cylinder 12 can be omitted. Thus, the manufacturing steps thereof can be simplified. In addition, in the glow plug 1, the outer cylinder 12 is fixed in the housing 14 not by press fitting but by brazing. Thus, the step itself is also simplified. Furthermore, each of the components, such as the lead rod 16, the large-diameter lead section 13, and the outer cylinder 12, does not have a complicated shape or structure but is simplified. Thus, the manufacturing cost can also be cut. Moreover, even in the case where the glow plug 1 is manufactured in such a manner that the tolerance of concentricity thereof exceeds the allowable limit, the fracture in the glow plug 1 can be prevented.

The glow plug that has been described so far merely illustrates one aspect of the invention and thus does not limit the invention. The embodiment thereof can arbitrarily be changed within the scope of the invention.

REFERENCE SIGNS LIST

1: ceramic heater-type glow plug
11: ceramic heater

12: metallic outer cylinder
13*a*: first large-diameter lead section
13*b*: second large-diameter lead section
14: housing
15: elastic member
16: external connection terminal
114 other electrode
115: one electrode
143: inner hole

The invention claimed is:

1. A ceramic heater-type glow plug comprising:

a ceramic heater;

a metallic outer cylinder, one end side of which holds the ceramic heater and an other end side of which is inserted in and fixed to an inner hole of a housing, one electrode of the ceramic heater on an outer circumferential surface of the ceramic heater and an other electrode at a rear end of the ceramic heater;

a first large-diameter lead section that is connected to the other electrode and has electrical conductivity;

a second large-diameter lead section that is connected to a rear end of the first large-diameter lead section and is made of an electrically conductive material that differs from the first large-diameter lead section;

an elastic member with electrical conductivity that is connected to a rear end of the second large-diameter lead section by welding; and an external connection terminal that is connected to a rear end of the elastic member.

2. The ceramic heater-type glow plug according to claim 1, wherein the second large-diameter lead section is made of iron, an iron alloy, nickel, or a nickel alloy.

3. The ceramic heater-type glow plug according to claim 1, wherein the elastic member is made of iron, an iron alloy, nickel, or a nickel alloy.

4. The ceramic heater-type glow plug according to claim 1, wherein each of the ceramic heater and the outer cylinder, the ceramic heater and the first large-diameter lead section, and the first large-diameter lead section and the second large-diameter lead section is brazed.

5. The ceramic heater-type glow plug according to claim 1, wherein the elastic member is a compression coil spring, and the elastic member is connected to the second large-diameter lead section and the external connection terminal in a state where a strand of the compression coil spring is in close contact therewith.

6. The ceramic heater-type glow plug according to claim 1, wherein rigidity of the first large-diameter lead section is lower than rigidity of the external connection terminal.

7. The ceramic heater-type glow plug according to claim 1, wherein the first large-diameter lead section is made of copper, a copper alloy, aluminum, an aluminum alloy, or cast iron.

8. The ceramic heater-type glow plug according to claim 1, wherein in the case where a diameter of the first large-diameter lead section is set as 1.0, axial length of the first large-diameter lead section has a value of 2.0 or higher.

9. The ceramic heater-type glow plug according to claim 1, wherein in the case where a lateral cross-sectional area of the ceramic heater is set as 1.0, a lateral cross-sectional area of the first large-diameter lead section has a value within a range from 0.2 to 0.4.

10. The ceramic heater-type glow plug according to claim 1, wherein a lateral cross-sectional area of the second large-diameter lead section is the same as the lateral cross-sectional area of the first large-diameter lead section.

11. The ceramic heater-type glow plug according to claim 2, wherein the elastic member is made of iron, the iron alloy, nickel, or the nickel alloy.

12. The ceramic heater-type glow plug according to claim 11, wherein each of the ceramic heater and the outer cylinder, the ceramic heater and the first large-diameter lead section, and the first large-diameter lead section and the second large-diameter lead section is brazed.

13. The ceramic heater-type glow plug according to claim 12, wherein the elastic member is a compression coil spring, and the elastic member is connected to the second large-diameter lead section and the external connection terminal in a state where a strand of the compression coil spring is in close contact therewith.

14. The ceramic heater-type glow plug according to claim 13, wherein rigidity of the first large-diameter lead section is lower than rigidity of the external connection terminal.

15. The ceramic heater-type glow plug according to claim 14, wherein the first large-diameter lead section is made of copper, a copper alloy, aluminum, an aluminum alloy, or cast iron.

16. The ceramic heater-type glow plug according to claim 15, wherein in the case where a diameter of the first large-diameter lead section is set as 1.0, axial length of the first large-diameter lead section has a value of 2.0 or higher.

17. The ceramic heater-type glow plug according to claim 16, wherein in the case where a lateral cross-sectional area of the ceramic heater is set as 1.0, a lateral cross-sectional area of the first large-diameter lead section has a value within a range from 0.2 to 0.4.

18. The ceramic heater-type glow plug according to claim 17, wherein a lateral cross-sectional area of the second large-diameter lead section is the same as the lateral cross-sectional area of the first large-diameter lead section.

* * * * *